US010745861B2

(12) United States Patent
Gomez Estella et al.

(10) Patent No.: US 10,745,861 B2
(45) Date of Patent: Aug. 18, 2020

(54) SECURITY STRIP AND SECURITY PAPER

(75) Inventors: Maria Jesus Gomez Estella, Burgos (ES); Javier Baraja Carracedo, Burgos (ES); Juan Antonio Rubio Sanz, Burgos (ES); Antonio Olmos Ruiz, Burgos (ES)

(73) Assignee: FABRICA NACIONAL DE MONEDA Y TIMBRE REAL CASA DE LA MONEDA (ES)

( * ) Notice: Subject to any disclaimer, the term of this patent is extended or adjusted under 35 U.S.C. 154(b) by 1220 days.

(21) Appl. No.: 11/908,255

(22) PCT Filed: Dec. 30, 2005

(86) PCT No.: PCT/ES2005/000712

§ 371 (c)(1),
(2), (4) Date: Sep. 23, 2008

(87) PCT Pub. No.: WO2006/095033

PCT Pub. Date: Sep. 14, 2006

(65) Prior Publication Data

US 2009/0302595 A1 Dec. 10, 2009

(30) Foreign Application Priority Data

Mar. 10, 2005 (ES) ..... 200500563

(51) Int. Cl.

| | |
|---|---|
| ***B42D 15/00*** | (2006.01) |
| ***D21H 21/42*** | (2006.01) |
| ***B42D 25/355*** | (2014.01) |

(52) U.S. Cl.

CPC ..... *D21H 21/42* (2013.01); *B42D 25/355* (2014.10)

(58) Field of Classification Search

CPC ..... B42D 15/0026

(Continued)

(56) References Cited

U.S. PATENT DOCUMENTS

| | | | | |
|---|---|---|---|---|
| 28,370 A * | 5/1860 | Howell | ..... | 283/111 |
| 964,014 A * | 7/1910 | Gernaert | ..... | B01D 17/045 162/104 |

(Continued)

FOREIGN PATENT DOCUMENTS

| | | |
|---|---|---|
| EP | 0 338 378 | 10/1989 |
| EP | 0 536 855 | 4/1993 |

(Continued)

OTHER PUBLICATIONS

Hawley's Condensed Chemical Dictionary, 2002, John Wiley & Sons Inc., 14th Edition.*
European Search Report dated Jan. 29, 2010.

*Primary Examiner* — Ian A Rummel
(74) *Attorney, Agent, or Firm* — Ostrolenk Faber LLP

(57) ABSTRACT

The invention relates to a security strip and security paper for obtaining security documents such as legal tender notes, checks or identification documents, comprising a cellulose support web that is completely embedded in a pulp substrate. As both the substrate and the support web are formed by plant fibers, a series of physical and chemical bonds are established between the fibers of both elements, the support web thus being perfectly integrated in the pulp. The cellulose support web will sometimes have a series of security elements, such as pigments, synthetic elements and/or security fibers of the type normally used in this type of application.

24 Claims, 2 Drawing Sheets

(58) Field of Classification Search
USPC ..... 428/195.1
See application file for complete search history.

(56) References Cited

U.S. PATENT DOCUMENTS

| | | | | | |
|---|---|---|---|---|---|
| 3,772,124 | A * | 11/1973 | Mayer | 156/324 | |
| 4,437,935 | A * | 3/1984 | Crane, Jr. | 162/103 | |
| 4,534,398 | A * | 8/1985 | Crane | 162/103 | |
| 4,552,617 | A * | 11/1985 | Crane | 162/103 | |
| 4,756,557 | A * | 7/1988 | Kaule | D21H 21/48 | 283/85 |
| 4,943,093 | A * | 7/1990 | Melling et al. | 283/83 | |
| 5,143,583 | A * | 9/1992 | Marchessault et al. | 162/138 | |
| 5,324,079 | A * | 6/1994 | Kaule | D21H 21/48 | 162/125 |
| 6,085,903 | A * | 7/2000 | Jotcham et al. | 206/459.5 | |
| 6,592,716 | B1 * | 7/2003 | Kim | D21H 15/04 | 162/140 |
| 2002/0029861 | A1 * | 3/2002 | Krukonis et al. | 162/199 | |
| 2003/0104176 | A1 * | 6/2003 | Schwenk | 428/195 | |
| 2003/0194578 | A1 * | 10/2003 | Tam et al. | 428/690 | |
| 2005/0181166 | A1 * | 8/2005 | Rancien | 428/41.9 | |
| 2008/0305313 | A1 | 12/2008 | Crane et al. | 428/211.1 | |

FOREIGN PATENT DOCUMENTS

| | | |
|---|---|---|
| EP | 0 557 157 | 8/1993 |
| ES | 2 145 486 | 7/2000 |
| GB | 1 095 286 | 12/1967 |
| GB | 2 325 883 | 12/1998 |
| GB | 2 387 813 | 10/2003 |
| JP | 2-133697 | 5/1990 |
| JP | 2001-159094 | 6/2001 |
| WO | WO 2007/001360 | 1/2007 |

* cited by examiner

SECURITY STRIP AND SECURITY PAPER

CROSS REFERENCE TO RELATED APPLICATION

The present application is a 35 U.S.C. §§ 371 national phase conversion of PCT/ES2005/000712, filed Dec. 30, 2005, which claims priority of Spanish Patent Application No. P200500563, filed Mar. 10, 2005, the disclosure of which has been incorporated herein by reference. The PCT International Application was published in the Spanish language.

OBJECT OF THE INVENTION

The present invention relates to security paper for manufacturing valuable documents (bank notes, checks, etc.) or identification documents (passports, driving licenses, etc.), as well as the security strip comprised in said paper which makes the counterfeiting thereof difficult.

The security paper object of this invention comprises a substrate consisting of a pulp in which a series of cellulose supports are embedded, which supports can contain in turn a great variety of security elements.

BACKGROUND OF THE INVENTION

The attempt to counterfeit valuable documents, especially notes, is a fraudulent activity that is as old as the existence itself of said documents.

All those elements contributing to the authentication of the document in question or which makes their counterfeiting as difficult as possible are included in the security element concept. Said security elements basically consist of a particular coating in the surface of the substrate or an element comprised or applied to the surface of the substrate.

The use of special printing processes providing the security documents with a relief that can be perceived by touch, such as the one incorporated in some elements of the current Euro notes of different denominations is known. These tactile marks further fulfill the purpose of aiding the blind in identifying said documents.

In contrast to the previous method, the incorporation of security marks formed by holes is also known, which marks, like the previous ones, have the advantage of being easily verifiable without the need for special equipment. Document ES 2 145 486 T3 describes a method for carrying out marks of this type by using laser light, a method by which holes are obtained having a diameter such that they are invisible when looked at in reflection whereas they are visible in plain sight when looked at in transmission, i.e., when looking at them against a light source.

Security documents, especially banknotes, frequently incorporate optically variable devices such as security threads, holograms, layers of interference elements or liquid crystal materials providing different color effects depending on the viewing angle, making counterfeiting the document by photocopying it extremely difficult.

A usual security element in valuable documents is the incorporation of the so-called watermarks, representing a figure or group of characters that can only be seen when the document is looked at against the light. The manufacture of papers incorporating this type of marks is carried out in paper manufacturing machines with a perforated cylindrical drum, therefore the elevation or areas impermeable to water reduce the depositing of fibers on the surface of said drum and therefore the sheet of paper thus manufactured has locally different thicknesses.

As regards the incorporation of holograms in security documents, the usual method consists of manufacturing the so-called main holograms and from them casting the holograms required per copy in the press molds, thus obtaining large amounts of holograms. Cast holograms are normally manufactured as multi-layer elements on a separate carrier, such that they are joined to the document in question by means of a layer of adhesive material. This manufacturing method has deficiencies with respect to document security because it is possible to remove the hologram from the document by heating the adhesive material and therefore, transferring said hologram to a counterfeit document, adhering it thereto.

Document EP 0 338 378 B1 describes a process for manufacturing security documents including holograms solving the previous drawback, because in this case the hologram is cast directly on the material forming the document, first printing the paper on both sides and subsequently providing said paper with a holographic structure in certain areas. The process consists of simultaneously transferring to the paper forming the security document both the casting resin and the hologram relief structure, coating the surface structure of the mold of the press with a curable resin. Once the mold and the paper come into contact, the resin adheres to the surface of the paper after it has been cured, having a holographic structure in relief. A thin metallized layer allowing observation by reflection of the holographic information is subsequently vacuum-applied. The drawback of this manufacturing process lies in the need to cure the resin by means of electron radiation, which curing is complex, damaging for the paper and involves high costs.

In view of the foregoing, the object of the present invention is to develop paper for forming security documents allowing the incorporation of several security elements that cannot be easily detached from said documents and which prevent their counterfeiting to a considerable extent, it also being desirable that the obtained paper has homogenous surfaces and is stable for all purposes.

DESCRIPTION OF THE INVENTION

The invention consists of a security strip comprising a cellulose support web formed by plant fibers.

The plant fibers which can be used to manufacture said support web come from wood or are fibers coming directly from plants and are extracted from the trunk, branches, bark, roots, leaves, stems, etc. Cotton, flax, hemp, and jute are some of these cellulose-producing plants, although the possibility of obtaining fibers from many other plants or even from cereal chaff is not discarded. Once the plant fibers are obtained a continuous web with variable dimensions according to its final application is manufactured, although in most cases it will have a basically rectangular section with small dimensions. The type of paper forming this cellulose support web is a special paper with a suitable weight (up to 80 g/m$^2$) and reduced thickness for this application.

The security strip object of this invention comprises at least one cellulose support web as previously described, although said security strip can incorporate other elements, such as the security elements normally used in this type of application, the purpose of which elements is to make the counterfeiting of said security strip as difficult as possible. The use of security pigments, synthetic elements and security fibers, both individually and combining different types of elements in the same security strip, is contemplated among the security elements that can be incorporated in the mentioned strip.

However, the object of the invention is not exclusively limited to the previously described security strip but it further comprises the security paper containing it. Said security paper comprises a substrate and at least one security strip.

The substrate comprises a pulp comprising plant fibers of those normally used for manufacturing this type pf paper, i.e., hygroscopic fibers that absorb moisture. The process for manufacturing this substrate is the usual process used in obtaining paper, mixing the fibers in the required proportions and forming the aqueous pulp containing the plant fibers.

As indicated previously, the security strip comprises at least one cellulose support web. Said web, obtained independently of the substrate, is introduced in the paper machine in which the substrate is being manufactured, specifically at the time in which the wet sheet of paper is being formed. By means of an electromechanical application system consisting of a specific web feed system for this application, formed by an unwinding assembly and a stress regulating system, as many cellulose support webs as desired either in the formation of the sheet of paper with a single layer or in the formation of the sheet of paper using two layers of paper joined together in the sheet formation step are introduced such that the final result is a single sheet of paper. As many cellulose support webs as desired can be introduced, with the determined web width and applying it at the points considered to be suitable according to the subsequent application which will be given to the obtained security paper. It is also possible to introduce the web or webs in the pulp according to different orientations, i.e. parallel, perpendicular or forming a certain angle with respect to the main axis of the sheet of paper which is being manufactured.

As the fibers forming both the support web and the substrate are plant fibers, the physical and chemical bonds are similar since the fiber binding mechanism is virtually the same independently of the origin of the plant fibers. Since their structure is compatible and they are also hygroscopic fibers, when the cellulose support webs are introduced in the pulp substrate being formed the cellulose support is absorbed by affinity into the fiber sheet with water and once inside that centre (wet sheet of paper), it loses its initial dryness, its cellulose fibers themselves being combined and forming physical and chemical bonds with the remaining fibers in the sheet being formed. These bonds are in turn reinforced by the effects of sizing agents incorporated in the substrate manufacturing process, said incorporation being either in the mass or on the surface. The usual sheet forming process is subsequently continued with the drainage and pressing elements commonly used, the final sheet slowly losing water and passing through the drying phase, thus reaching the end of the process and a security paper being obtained that is homogeneous, stable and with smooth surfaces, i.e. the cellulose support web cannot be sensed by touch since it is perfectly integrated in the body of the sheet.

According to this method, it is achieved that the cellulose support web is embedded in the pulp substrate, i.e., the surfaces of said web are completely coated by the substrate, the thickness of the pulp layer coating the web being able to be different in each of its lower and upper surfaces, therefore the invention is not limited to a centered positioning of said web inside the substrate, but the web can be moved upwards or downwards.

As disclosed previously, the security strip comprising a cellulose support web can further comprise a series of security elements. These security elements can be adhered to the surfaces of said web or can be contained therein, supported by the plant fibers forming the cellulose support web. These elements, which are characteristic of this type of applications, prevent the counterfeiting of documents obtained from the manufactured security paper or make it as difficult as possible.

The security elements can consist of the incorporation in the support web of security pigments, synthetic security elements, security fibers or any other material or product considered to be suitable. The possibility that the same support web incorporates different security elements, whether or not they belong to the same group of those defined according to the previous classification, is also contemplated.

The pigments could be incorporated in the mass of the web or form part of a dye with which the characters (alphanumerical characters, symbols, figures, points, bar codes, etc.) are printed on the surface of the web, the possibility that the same web comprises pigments integrated in its mass as well as characters printed in its surface also being considered. Thus, pigments used normally for coloring paper, for manufacturing dyes, and all those pigments used with an additional security feature such as fluorescent, phosphorescent, luminescent, heat-sensitive, magnetic, expandable pigments, etc., are contemplated The incorporation of synthetic elements in the support web as a security element offers multiple possibilities, since pigments like the ones described previously can be included in said elements, which pigments confer features of color, fluorescence, phosphorescence, luminescence, heat-sensitivity, magnetism, expansibility, etc. to the element itself. The generic name of synthetic elements includes spheres, fibrils and generally bodies of any regular or irregular shape which can sometimes contain security pigments. As described previously, the possibility that a single cellulose support web can comprise different types of synthetic elements (for example, spheres and fibrils), both alone and combined with security pigments in the mass of the web or printed on the surface thereof, is contemplated.

Metallic fibers and/or fibers with magnetism features, with a different geometries and measurements, in addition to the synthetic fibers with pigmentation included in the description of the previous paragraph are among the possible security fibers comprised in the support web. As in the previous cases, the incorporation of any of these types of security fibers can be accompanied by the inclusion of pigments and/or synthetic security elements.

The invention also contemplates the security document comprising the previously described security paper. The security document is obtained from said paper, cutting it according to the desired dimensions for the document in question and printing the characters and drawings in question thereupon. The security documents that can be obtained from the security paper are mainly classified into valuable documents (legal tender notes, checks, etc) and identification documents (passports, identity documents, etc.), although it is contemplated that the document in question can have any other purpose for which it is considered to be suitable to incorporate security elements preventing the counterfeiting thereof.

One of the specific applications of the invention consists of the use of the security paper containing the previously described security strip for obtaining legal tender notes, since such notes are usually the object of counterfeiting attempts due to the monetary value they represent. The note thus obtained has a high degree of security and further has advantages compared to known notes, for example in the fact that when the security strip comprising the security elements is completely embedded in the pulp, it is possible to separate it without this involving the destruction of the note in question, which makes its counterfeiting difficult.

DESCRIPTION OF THE DRAWINGS

To complement the description which is being made and with the aim of aiding to better understand the features of the invention according to a preferred embodiment thereof, a set of drawings is attached as an integral part of said description in which the following is shown with an illustrative and non-limiting character.

PREFERRED EMBODIMENT OF THE INVENTION

In view of the drawings, these show an embodiment of the invention consisting of a security strip (1) comprising a cellulose support web (2) formed by plant fibers (4). Said security strip (1) is applicable in the manufacture of paper intended for obtaining security documents such as legal tender notes (9), checks or passports, among others.

Figure 1:
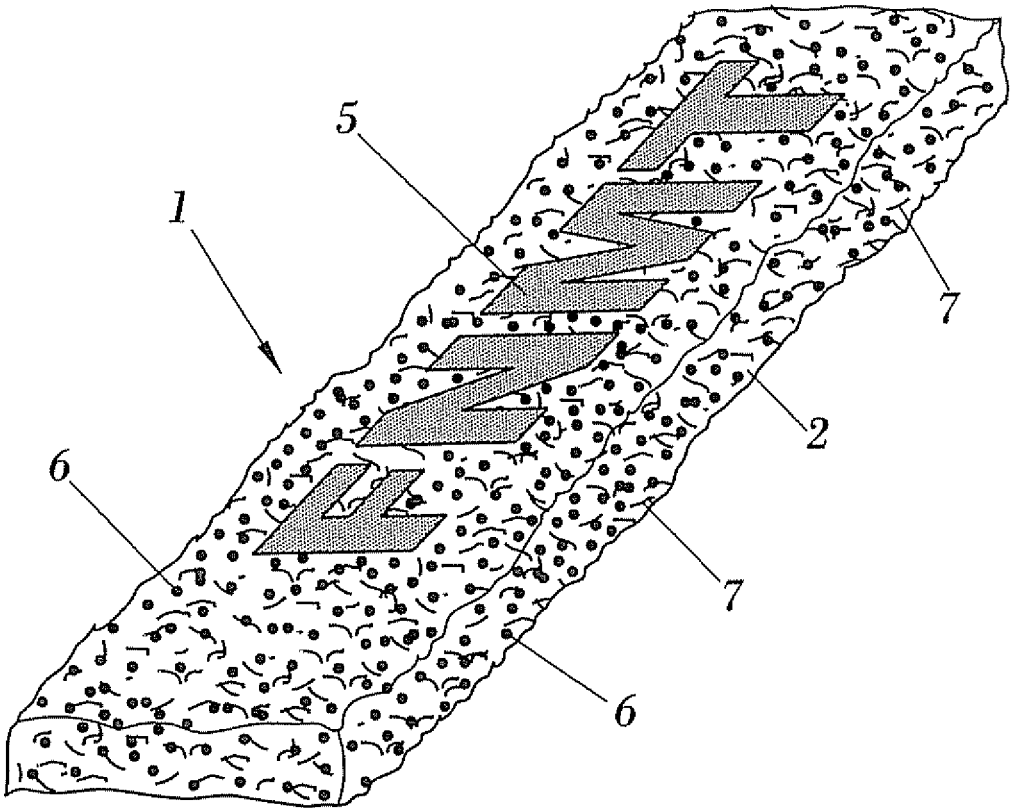
FIG. 1 shows a perspective view of a security strip according to the invention.

FIG. 1 shows a specific embodiment of the security strip (1) object of this invention. In this case, the strip shown comprises security elements such as security pigments (5) printed in the surface thereof, synthetic security elements (6) and security fibers (7) comprised in the cellulose support web (2).

Figure 2:
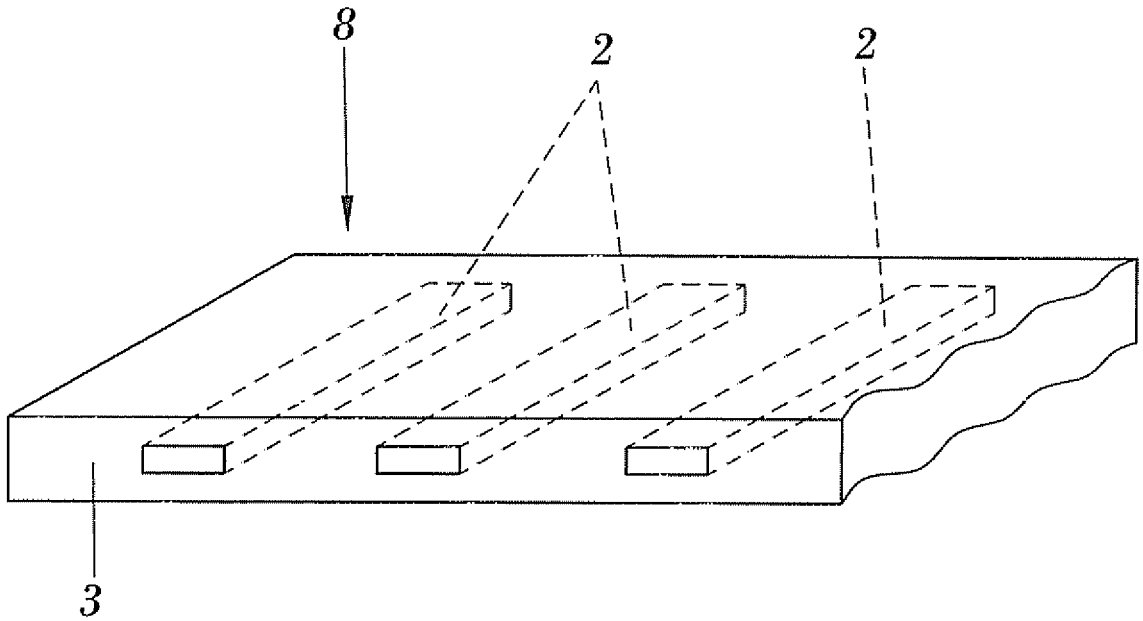
FIG. 2 shows a perspective view of a sheet of security paper comprising several cellulose support webs.

FIG. 2 shows a perspective view of a sheet of security paper (8) as obtained after passing through the rollers conferring the suitable smoothness and thickness to the paper, before passing through the winding machine which will wind the sheet of paper. The paper shown comprises a substrate (3) consisting of a pulp formed from plant fibers (4), water and other components usually added during the process and several cellulose support webs (2) completely embedded in said substrate (3), said webs being perfectly integrated in the pulp, as can be observed in the figure. In this specific embodiment, the support webs (2) have been introduced perpendicular to the main direction of the sheet of paper, considering as main direction that according to which the paper leaves the machine. However, the possibility of arranging said webs in any other direction is not discarded, and the possibility that that they do not affect the total width of the sheet if the subsequent application of the paper obtained so requires is also contemplated.

Figure 3:
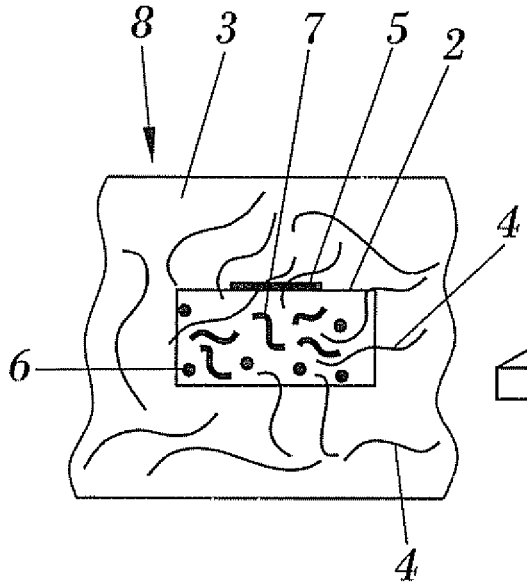
FIG. 3 shows a detailed view of the cellulose support web containing security elements and comprised in the security paper.

As observed with more detail in FIG. 3, the plant fibers (4) comprised in the pulp substrate (3) and those comprised in the cellulose support web (2) combine with one another and form physical and chemical bonds between each other reinforced by the effects of sizing agents incorporated in the process for manufacturing the substrate (3), said incorporation being either in the mass or on the surface, the substrate (3) and the support web (2) then being perfectly bound, such that the support web (2) is completely integrated in said pulp but does not disappear as an independent element. This integration of the cellulose support web (2) in the pulp is due to the fact that the fibers comprised in both elements are plant fibers (4) and therefore their structure is similar, favoring the occurrence of bonds in the support web (2)-substrate (3) contact area, furthermore, since the fibers are plant fibers and therefore hygroscopic, i.e., they absorb moisture, the plant fibers (4) of both elements tend to swell, the adjacent fibers (4) belonging to the same element (support web (2) or pulp substrate (3)) being released and binding to the adjacent fibers (4) of the other element, thus giving rise to multiple new bonds between fibers (4).

In this case shown in FIG. 3 the cellulose support web (2) comprises different security elements, such as security pigments (5) printed on the one of the surfaces thereof, synthetic elements (6) or security fibers (7) with special features for this application. These security elements remain in the support web (2) despite the fact that the latter is completely integrated in the substrate (3).

Figure 4:
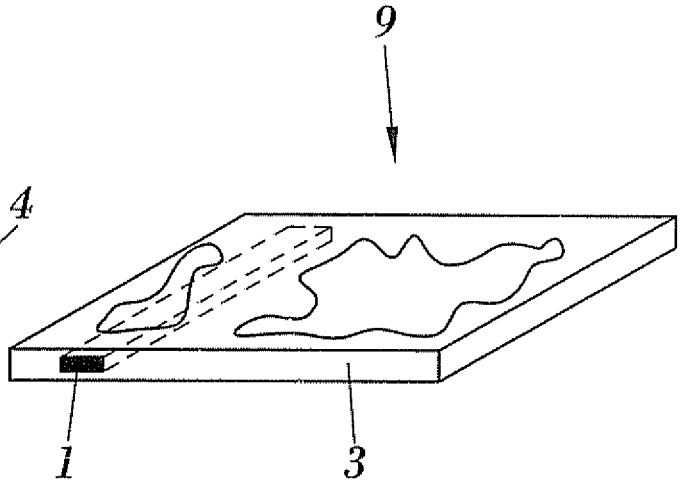
FIG. 4 shows a perspective view of a legal tender note according to the invention.

Once the sheet of security paper (8) object of this invention has been obtained, it is normally cut and printed so that said paper serves as the basis for obtaining any type of security documents, both valuable documents and identification documents. FIG. 4 shows a perspective view of a legal tender note (9) comprising the previously described security paper (8). As observed in this figure, the cellulose support web (2) comprising several security elements is completely embedded in the paper, the obtained note (9) being homogenous (the security strip (1) cannot be sensed by touch).

The manufacture of notes (9) and other documents based on this security paper (8) makes the possibility of detaching the security strip (1) for the counterfeiting thereof extremely difficult, likewise reducing the deterioration of said security strip (1) which, in the event that it were adhered to one of the surfaces of the paper, would undergo considerable damage as a result of its direct exposure to the outside.

The invention claimed is:

1. A security strip configured to be embedded in a substrate having hygroscopic plant fibers, said security strip comprising:

an elongated cellulose support web made of paper comprising plant fibers;

said cellulose support web comprising a body and security elements uniformly dispersed throughout the body; and said security strip being completely embeddable in said substrate, wherein the body of said cellulose support web remains in the substrate as an independent element without disappearing into the substrate when said substrate is wet, wherein exterior surfaces of said support web between terminal ends of said security strip are configured to make direct contact with said substrate and are configured to physically and chemically bond with said substrate, and wherein the security elements are not present on the surface of the security strip.

2. A security strip according to the claim 1, wherein the security elements comprise security pigments.

3. A security strip according to claim 1, wherein the security elements comprise synthetic security elements.

4. A security strip according to claim 1, wherein the security elements comprise security fibers.

5. A security strip according to claim 2, wherein the security pigments are selected from pigments used for coloring paper, pigments used in the manufacture of dyes and pigments with an additional security feature.

6. A security strip according to claim 5, wherein the pigments with an additional security feature are selected from fluorescent pigments, phosphorescent pigments, luminescent pigments, heat-sensitive pigments, magnetic pigments and expandable pigments.

7. A security strip according to claim 5, wherein the security pigments are incorporated in the mass of the support web.

8. A security strip according to claim 5, wherein the security pigments are a first pigment, wherein the first pigment is incorporated in characters selected from alphanumerical characters, symbols, figures, points and bar codes printed on the surface of the support web.

9. A security strip according to claim 3, wherein the synthetic security elements have a regular shape.

10. A security strip according to claim 9, wherein the synthetic security elements incorporate security pigments.

11. A security strip according to claim 4, wherein the security fibers are selected from metallic fibers and magnetic fibers.

12. A security strip according to claim 10, wherein the security pigments are selected from pigments used for coloring paper, pigments used in the manufacture of dyes and pigments with an additional security feature.

13. A security strip according to claim 12, wherein the pigments with an additional security feature are selected from fluorescent pigments, phosphorescent pigments, luminescent pigments, heat-sensitive pigments, magnetic pigments, and expandable pigments.

14. A security strip according to claim 1, wherein said paper weighs up to 80 g/m$^2$.

15. A security strip according to claim 1, wherein said cellulose support web includes security elements in its body.

16. A security strip according to claim 1, wherein said support web consists of plant fibers.

17. Security paper comprising:

a substrate comprising a pulp comprising plant fibers;

at least one security strip comprising an elongated cellulose support web made of paper comprising plant fibers and including a body and security elements uniformly dispersed throughout the body, wherein the cellulose support web is embedded in said substrate, the plant fibers of said cellulose support web forming physical and chemical bonds with the plant fibers in the substrate, and the body of said cellulose support web being integrated in the pulp while being retained as an independent element without disappearing into the substrate;

wherein said security strip is completely embedded in said substrate, wherein exterior surfaces of said cellulose support web between its terminal ends are in direct contact with said substrate and said security elements are inside said substrate and surrounded by said substrate, and wherein said security elements are not present on the surface of the security strip.

18. A security paper according to claim 17, wherein said substrate comprises two layers and said strip is embedded between said two layers.

19. A security paper according to claim 17, wherein said paper of the cellulose support web weighs up to 80 g/m$^2$.

20. A security paper according to claim 17, wherein said support web consists of plant fibers.

21. A security document wherein it comprises the security paper described in claim 17.

22. A legal tender note wherein it comprises the security paper described in claim 17.

23. A method for manufacturing a security paper according to claim 17, wherein said security strip is embedded in said substrate when said pulp is wet.

24. A method for manufacturing a security paper according to claim 17, comprising the step of joining two layers of paper together in a sheet formation step to produce a single sheet of said security paper, wherein said security strip is introduced between said two layers of paper.

* * * * *